US005493841A

United States Patent [19]

Van Wegen et al.

[11] Patent Number: 5,493,841

[45] Date of Patent: Feb. 27, 1996

[54] APPARATUS FOR PRODUCING PORTABLE, TUBE-LIKE PACKS FROM PRINTING PRODUCTS

[75] Inventors: Willem F. S. M. Van Wegen, Baarn, Netherlands; Hans-Ulrich Stauber, Grüt, Switzerland

[73] Assignee: Ferag AG, Hinwil, Switzerland

[21] Appl. No.: 220,745

[22] Filed: Mar. 31, 1994

[30] Foreign Application Priority Data

Apr. 1, 1993 [CH] Switzerland ..... 01000/93

[51] Int. Cl.[6] ..... B65B 63/04

[52] U.S. Cl. ..... 53/119; 53/118; 53/211; 53/389.3; 53/389.4; 53/587

[58] Field of Search ..... 53/118, 119, 211, 53/399, 430, 587, 389.3, 389.4

[56] References Cited

U.S. PATENT DOCUMENTS

| | | | |
|---|---|---|---|
| 486,090 | 11/1892 | Crowell | 53/119 |
| 2,732,063 | 1/1956 | Dedek et al. | 53/119 |
| 2,789,406 | 4/1957 | Mosier | 53/118 |
| 2,871,638 | 2/1958 | Goodwin | 53/119 |
| 2,931,149 | 4/1960 | Mitchell | 53/451 |
| 2,962,847 | 12/1960 | Thoele | 53/118 |
| 3,013,367 | 12/1961 | Sarre | 53/118 |
| 3,323,278 | 6/1967 | Murray | 53/119 |
| 3,991,538 | 11/1976 | Finn et al. | 53/118 X |
| 4,245,829 | 1/1981 | Coast | 53/118 X |
| 4,501,109 | 2/1985 | Monsees | 53/551 X |
| 4,608,807 | 9/1986 | Skripalle | 53/118 X |
| 4,651,941 | 3/1987 | Muller | 53/118 X |
| 4,748,793 | 6/1988 | Brookman . | |
| 4,754,593 | 7/1988 | Ishihara et al. | 53/551 X |
| 4,765,118 | 8/1988 | Akutsu et al. | 53/133.5 |
| 4,811,548 | 3/1989 | Reist . | |
| 4,909,015 | 3/1990 | Leu . | |
| 5,101,610 | 4/1992 | Honegger . | |
| 5,163,265 | 11/1992 | Darcy et al. | 53/118 |

FOREIGN PATENT DOCUMENTS

| | | | |
|---|---|---|---|
| 121185 | 3/1946 | Australia | 53/119 |
| 147136 | 7/1952 | Australia | 53/119 |
| 1358472 | 2/1972 | United Kingdom . | |

*Primary Examiner*—John Sipos
*Assistant Examiner*—Daniel Moon
*Attorney, Agent, or Firm*—Bell, Seltzer, Park & Gibson

[57] ABSTRACT

The printing product (16) is inserted from above into a compartment (52) and between two pairs of fingers (56), and is positioned such that it is arranged approximately symmetrically with respect to the axis of rotation (54') of the fingers (56). Upon rotation of the fingers, the printing product is folded by interaction with flexible belts (114, 116) in an S-shaped form and is thus brought into a tube-like configuration. A film-like retaining element (34) is wound up along with the printing product (16), in order to sheath the printing product (16) and maintain it in the tube-like configuration.

16 Claims, 9 Drawing Sheets

APPARATUS FOR PRODUCING PORTABLE, TUBE-LIKE PACKS FROM PRINTING PRODUCTS

BACKGROUND OF THE INVENTION

The present invention relates to an apparatus for producing portable, tube-like packs from printing products, such as a newspaper or periodical.

An apparatus of the described type is known from U.S. Pat. No. 4,748,793. The apparatus has a stub shaft which is rotatable about its longitudinal axis and from which two fingers protrude in the axial direction. The longitudinal axes of the fingers are located in one axial plane together with the horizontal axis of rotation running centrally between them. At a standstill, this plane runs in the vertical direction, so that the printing product to be processed can be manually inserted between the fingers in the approximately horizontal direction. In this case, the printing product, a newspaper, is brought to bear against a stop parallel to the longitudinal axis by its edge opposite the fold, so that on the other side of the axial plane the printing product projects with a narrow edge region beyond the fingers. Arranged underneath the fingers is a counterelement, which has pressing rollers running parallel to the axis of rotation. For rolling the printing product, the fingers are turned about the axis of rotation, so that after half a revolution the printing product is bent around the one finger, facing the counterelement, and bears with its end region, facing the fold, flat on the upper side of the part of the printing product facing the stop. Upon further turning, these two mutually adjacent product regions are thus bent around the other finger and then the remaining part of the printing product is rolled up upon further turning of the fingers. Above the fingers there is a supply device for feeding a film-like retaining element. This device has a swivel-mounted feed arm, which inserts the edge section of a film web, unwound from a supply roller, from above into the gap between the mutually facing parts of the already partially rolled printing products. The film web is then rolled up together with the printing product, a desired tensile stress being built up and maintained in the film by means of a pair of dancer rollers. Once the newspaper has been completely rolled, the roll is further wrapped around by the film web and, upon swivelling back the feed arm, the film web is severed by means of a heating wire, so that the rolled-up end section forms a sheath for the printing product. For separating the finished pack from the fingers, the pressing rollers, which press the newspaper against the fingers during rolling, is swivelled away from the pack and the latter is manually drawn off the winding mandrel in the axial direction. This known apparatus requires manual operation, and considerable time for producing the pack.

An apparatus for rolling up printing products generated in imbricated formation and wrapping around the rolled-up printing products with a film-like retaining element to form a portable pack is known from EP-A-0 313 781 and the corresponding U.S. Pat. No. 4,909,015. By means of a belt conveyor, the printing products are fed in imbricated formation to a winding point, where they are wound up onto a winding mandrel by means of a looping-around strap. A supply device for the film web opens out from below into the feed path of the printing products. From a rotatably supported supply roller, the film web runs around a fixed-in-place deflecting roller to a conveying roller, driven in start/stop operation. Between the latter and the feed path of the printing products there is a conveyor belt which is driven in permanent circulation and against which the film web bears in certain regions in order to tension itself and keep itself under tensile stress. There also bears against the film web, between the supply roller and the deflecting roller, a weight roller, in order to keep the film web tensioned. When feeding the printing products to the winding mandrel, the end region of the imbricated formation is provided with the film web at substantially the same speed as the conveying speed, by the conveying roller being connected to the drive. A heating wire then severs the film web, so that, after rolling on around the wound-up printing products, the detached section sheathes the latter, in order to hold the pack together and protect it against environmental effects. The finished pack is then pushed off the winding mandrel by means of an ejector. This known apparatus is designed for rolling up printing products generated in imbricated formation.

Further apparatuses for winding up printing products generated in imbricated formation and sheathing the rolled-up printing products with a retaining element to form portable packs are known from EP-A-0 474 999 or the corresponding U.S. Pat. No. 5,101,610 and EP-A-0 243 906 or the corresponding U.S. Pat. No. 4,811,548.

An apparatus for rolling up a single printing product together with a film-like retaining element to form a tube-like portable pack is described in the older Swiss Patent Application No. 01 440/92-0. This apparatus has a slit winding mandrel, so that the fingers formed as a result are unsubstantially further apart than the thickness of the printing product to be wound up. The latter is introduced between the fingers by means of belt conveyors in the horizontal direction, the printing product being provided with a section of a film web which grips around the leading edge of the printing product and projects beyond the trailing edge. The printing product is inserted so far into the gap that the leading edge is approximately at the end of the gap. The winding mandrel rests on a belt conveyor arrangement, which acts during turning of the winding mandrel as a counterelement and bends the printing product around the one finger and then, during rolling, presses against the outer side of the winding mandrel. As soon as the section of the retaining element projecting beyond the trailing edge of the printing product is wound up, the winding mandrel is moved out in the axial direction from the pack thus formed and the pack is conveyed away, by the belt conveyor arrangement continuing to be driven and by stopping a pressing device of a ribbon conveyor type bearing against the pack.

It is an object of the present invention to provide an apparatus of the described type which is suitable for automatic operation and has a great processing capacity.

SUMMARY OF THE INVENTION

The above and other objects and advantages of the present invention are achieved by the provision of an apparatus which comprises a machine frame, a bearing part rotatably mounted to the frame for rotation about a horizontal axis of rotation, and at least one pair of fingers mounted to the bearing part so that the fingers are disposed along parallel axes which are parallel to and on opposite sides of the axis of rotation. A pair of upright counter-elements are mounted to the frame in generally opposing relationship and on respective opposite sides of the axis of rotation and outside of the one pair of fingers, and drive means is provided for selectively rotating the bearing part and thus the one pair of fingers about the axis of rotation and such that the one pair of fingers may be rotated to a horizontally spaced apart initial position which defines a horizontal plane. Printing product conveying means is provided for serially delivering printing products vertically between the one pair of fingers when the fingers are in the initial position and to an operative position wherein the printing product is positioned substantially symmetrically with respect to the axis of rotation.

Upon delivery of a printing product to the operative position, the bearing part may be rotated about the axis of rotation and so that one of the fingers presses one portion of the printing product into contact with one of the counter-elements and the other of the fingers presses another portion of the printing product into contact with the other of the counter-elements, thereby causing the printing product to be bent about the fingers and formed into a wound pack.

The apparatus of the present invention preferably also comprises means for feeding and applying a retaining element to the wound pack and so as to maintain the wound pack in its wound form.

The apparatus according to the present invention is suitable in particular for processing newspapers or periodicals which are packed ready-for-despatch individually or in a small number of copies. It is particularly suitable for processing single, multi-sheet thick printing products. However, it is also suitable for processing single thinner printing products or a plurality of thin printing products lying congruently one on top of the other. The printing products are inserted individually or lying congruently one on top of the other between two fingers by means of a conveying apparatus, so that they are arranged approximately symmetrically with respect to the axis of rotation. Two counterelements, lying approximately opposite each other with respect to the axis of rotation, interact with the fingers upon turning of the fingers and counterelements in relation to one another, in order to bend each half of the printing product around one of the fingers. By this measure, only a few revolutions of the fingers are necessary in order to bring the printing product into the tube-like form. Preferably, in this case the fingers are spaced so far apart that the printing product brought into the tube-like form has approximately an S-shaped cross section. In order to keep the printing product in the tube-like form, a retaining element is applied to the printing product. In this case, this may be a film-like sheathing element, which circumferentially surrounds the printing product completely in order also to protect it against environmental effects. It is also possible, however, to bind around or grip around the printing product brought into the tube-like form.

The preferred embodiment of the apparatus according to the invention also includes a particularly suitable supply device for a film-like retaining element, which is conveyed at a certain speed and is then drawn further at greater speed.

BRIEF DESCRIPTION OF THE DRAWINGS

The present invention is now described in more detail with reference to an illustrative embodiment represented in the drawing, in which, purely diagrammatically.

DETAILED DESCRIPTION OF THE PREFERRED EMBODIMENT

Figure 1:
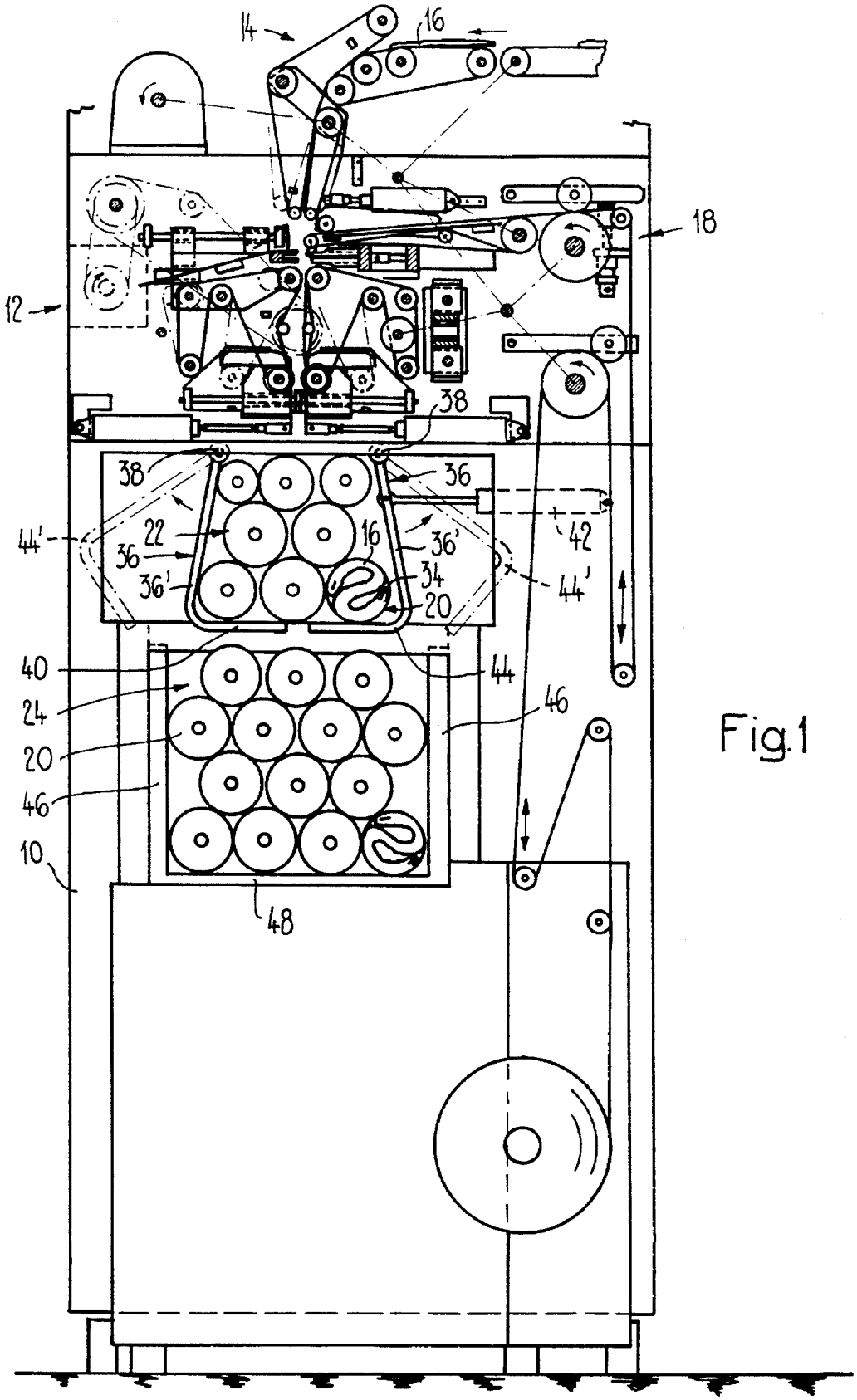
FIG. 1 shows in elevation an apparatus for processing printing products having an apparatus for producing portable tube-like packs and an apparatus for forming bundles of a plurality of these packs.
Figure 2:
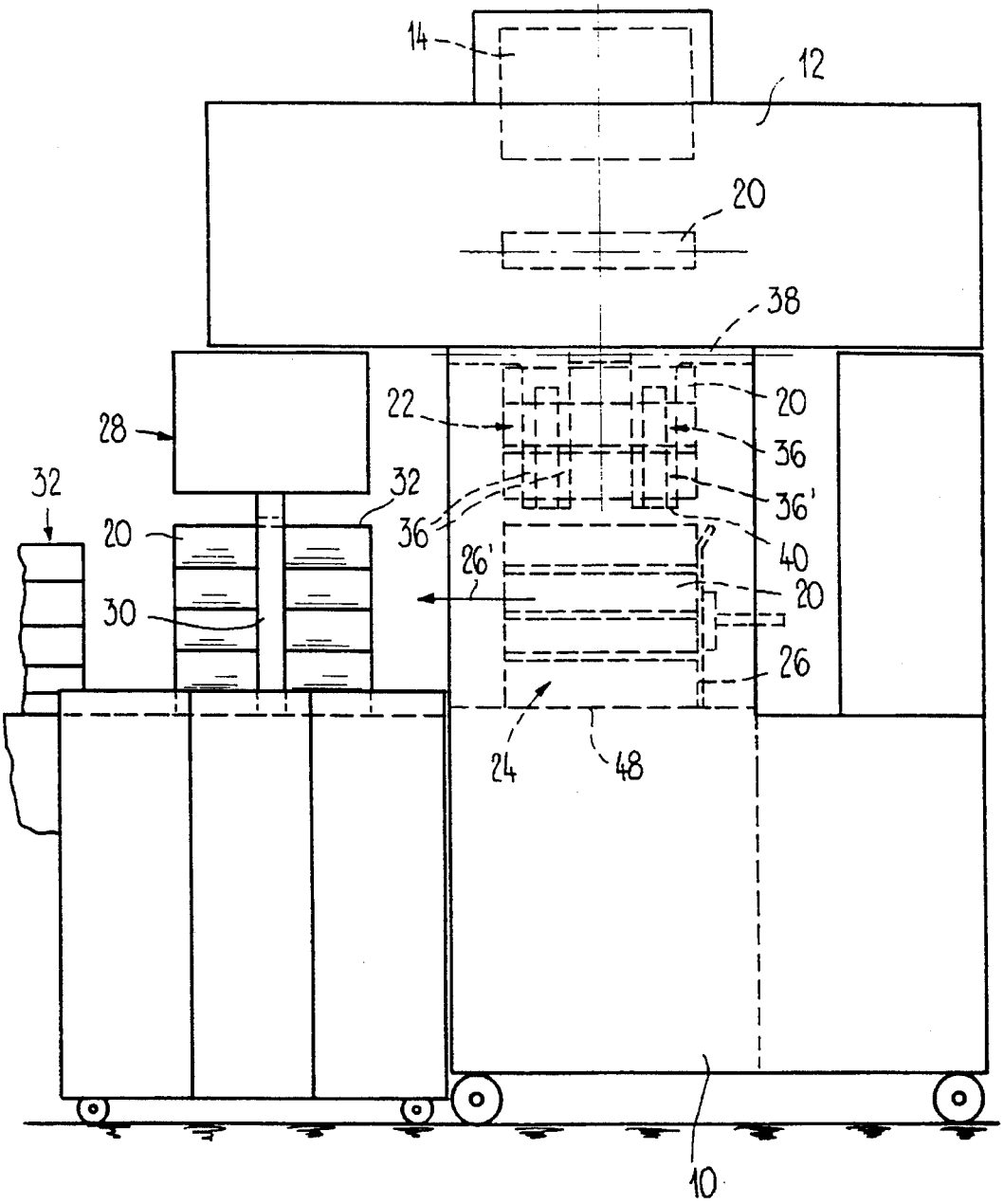
FIG. 2 shows in side elevation and further simplified the apparatus according to FIG. 1.

FIGS. 1 and 2 show a pack-producing apparatus 12, which is arranged in a machine frame 10 and forms portable, tube-like packs 20 from printing products 16, fed by means of a conveying device 14, and film-like retaining elements, supplied by a supply device 18.

Arranged underneath the pack-producing apparatus 12 is a first stack compartment 22 of a stacking device, into which the packs 20 are dropped by the pack-producing apparatus 12. Underneath the first stack compartment 22 there is a second stack compartment 24, to which the packs 20 collected in the first stack compartment 22 are transferred. The second stack compartment 24 is assigned an ejector 26, by means of which the packs 20 are pushed out of the second stack compartment 24 and are fed to a strapping device 28. The latter lays a strap 30 around the packs 20, so that the latter form together with the strap 30 a stable bundle 32, suitable for transporting and easy to handle.

Figure 17:
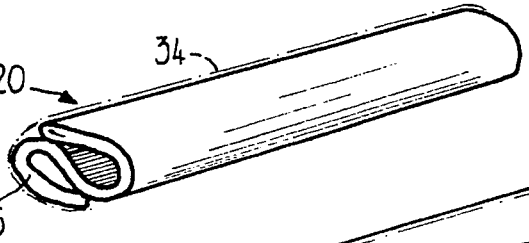
FIG. 17 shows in perspective representation the pack produced by the apparatus according to FIGS. 3 to 16.

The pack-producing apparatus 12 is described in more detail further below. For the moment, it suffices to know that with it single printing products 16 or a plurality of printing products 16 lying congruently one on top of the other are folded in S-shaped form and sheathed by a film-like retaining element 34 to form a portable, tube-like pack 20, as FIG. 17 shows. The pack-producing apparatus 12 successively outputs such packs 20 and drops them from above into the first stack compartment 22, the longitudinal extent of all the packs 20 running in the same direction.

The first stack compartment 22 is bounded by two fork-like stack compartment walls 36, which are swivel-mounted about horizontal spindles 38 at their upper end. The horizontal spindles 38 run parallel to each other and in the direction of the longitudinal extent of the packs 20 supplied by the pack-producing apparatus 12. The prongs 36' forming the stack compartment walls 36 are each bent at the lower end of the stack compartment wall 36 in the direction toward the other stack compartment wall 36, so that they simultaneously form the base 40 of the first stack compartment 22. The prongs 36' are able to be swivelled by means of a cylinder-piston unit 42 out of a stacking position 44, indicated in FIG. 1 by solid lines, about the horizontal spindles 38 away from each other into an emptying position 44', indicated by dot-dashed lines. In stacking position 44, the first stack compartment 22 is closed at the bottom by the parts of the prongs 36' forming the base 40, whereas in open position 44' the first stack compartment 22 is open at the bottom and the free ends of the prongs 36' are approximately above the stack compartment walls 46 of the second stack compartment 24. These stack compartment walls 46 and the base 48 of the second stack compartment 24 are formed by fixed-in-place metal plates or by roller conveyors. In the case of roller conveyors, the rollers run at right angles with respect to the longitudinal extent of the packs 20. The packs 20 stacked in the second stack compartment 24 are pushed out of the second stack compartment 24 by means of the ejector 26, driven in arrow direction 26' (FIG. 2), for example by means of a piston-cylinder unit, and are fed to the strapping device 28. The latter has supporting elements, which are not shown for the sake of better overall clarity but are aligned with the stack compartment walls 26 and the base 48, in order to hold together the not yet strapped stacked packs 20. The strapping device 28 is of a generally known type of design and lays the strap 30 around the packs 20. The bundles 32 are conveyed away from the strapping device 28 by means of generally known conveying means for further processing.

The operating principle is as follows: with prongs 36' swivelled into stacking position 44, the packs 20 generated with great frequency are stacked in the first stack compartment 22. If there is a predetermined number of packs 20 in the first stack compartment 22, the prongs 36' are transferred by means of the cylinder-piston unit 42 into the emptying position 44', whereby the packs 20 fall into the second stack compartment 24. This requires only a short time and the prongs 36' are immediately swivelled back again into the stacking position 44, so that the subsequently generated packs 22 are in turn stacked in the first stack compartment 22. As soon as there are in turn a certain number of packs 20 in the first stack compartment 22, the latter is again emptied in the same manner into the second stack compartment 24. While the subsequent supplied packs 20 are then being stacked in the first stack compartment 22, the second stack compartment 24 is emptied by means of the ejector 26. Once the ejector 26 is withdrawn into its starting position, shown in FIG. 2, the first stack compartment 22 can then be emptied again into the second stack compartment 24. Due to the arranging of two stack compartments 22, 24 one above the other, there is consequently sufficient time available to empty the lower second stack compartment 24 without having to interrupt the production of the packs 20 to do so. Furthermore, the drop height of the packs 20 can be reduced to a minimum, so that they do not lose their alignment during falling and stacking. A high reliable processing speed is ensured as a result.

It is, of course, also conceivable to replace the strapping device 28 by a generally known binding device. It would also be possible to sheathe the stacked packs 20 in turn with a film. It would also be conceivable to arrange the stack compartment walls 36 fixedly and to form the base 40 by slide plates.

The pack-producing apparatus 12 is now described in more detail with reference to FIGS. 3 to 8. Two pairs of fingers 50 are arranged on mutually opposite sides of a compartment 52, each on a bearing part 54 mounted rotatably on the machine frame 10. The longitudinal axes 56', 56" of all four fingers 56 run parallel to the axis of rotation 54' of the bearing parts 54 and lie together with the latter in one axial plane 58. The two fingers 56 of the pairs of fingers 50 are arranged symmetrically with respect to the axis of rotation 54' and bound a gap-like opening, into which the printing product 16 to be processed can be inserted.

The rod-like fingers 56 extend through the relevant bearing part 54, are displaceable on the latter in the axial direction, but are mounted drive-fixedly in the rotating direction. The bearing parts 54 are connected by means of a toothed-belt drive 60 to a servo motor 62. On the side of the bearing parts 54 facing away from the compartment 52, the fingers 56 are fastened on a driving part 64, which is connected freely rotatably in the axial direction but drive-fixedly to a displacing device 66. The latter serves the purpose of drawing the fingers 56 out of the compartment 52 in the direction of the axis of rotation 54' and of pushing them back again into said compartment. The drawing out of the fingers 56 from the compartment 52 takes place at great speed. For braking this movement, on the side of the driving part 64 facing away from the compartment 52 there is arranged a braking device 68, which has two springs 70, 70' arranged one behind the other in the direction of the axis of rotation 54'. These springs are supported by their mutually facing ends on a driving element 72, which is seated fixedly on a driving shank 74. The first spring 70 has a steeper spring characteristic than the second spring 70' and is arranged on the side of the driving element 72 facing the driving part 64. Seated freely movably on the driving shank 74 is a stop member 76, on which the first spring 70 is supported and which is intended for interacting with the driving part 64. This second spring 70' is supported by its end remote from the driving element 72 on a supporting member 78, which is seated likewise on the driving shank 74, likewise freely movably, and for its part is supported on the machine frame 10 freely rotatably in the direction of the axis of rotation 54' but fixedly.

The driving shank 74 penetrates the driving part 64, engages in an opening in the bearing part 54 and bears at the end on this side a driving plate 80, on which there are fastened plastic sleeves 82, which are for their part penetrated by the fingers 56. The plastic sleeves 82 are mounted displaceably in the direction of the axis of rotation 54' in the bearing part 54, the plastic sleeves 82 projecting into the interior of the compartment 52 in their working position, shown in FIGS. 5, 6 and 7, and being drawn-back into the bearing part 54 in their withdrawn position, shown in FIG. 8.

Figure 3:
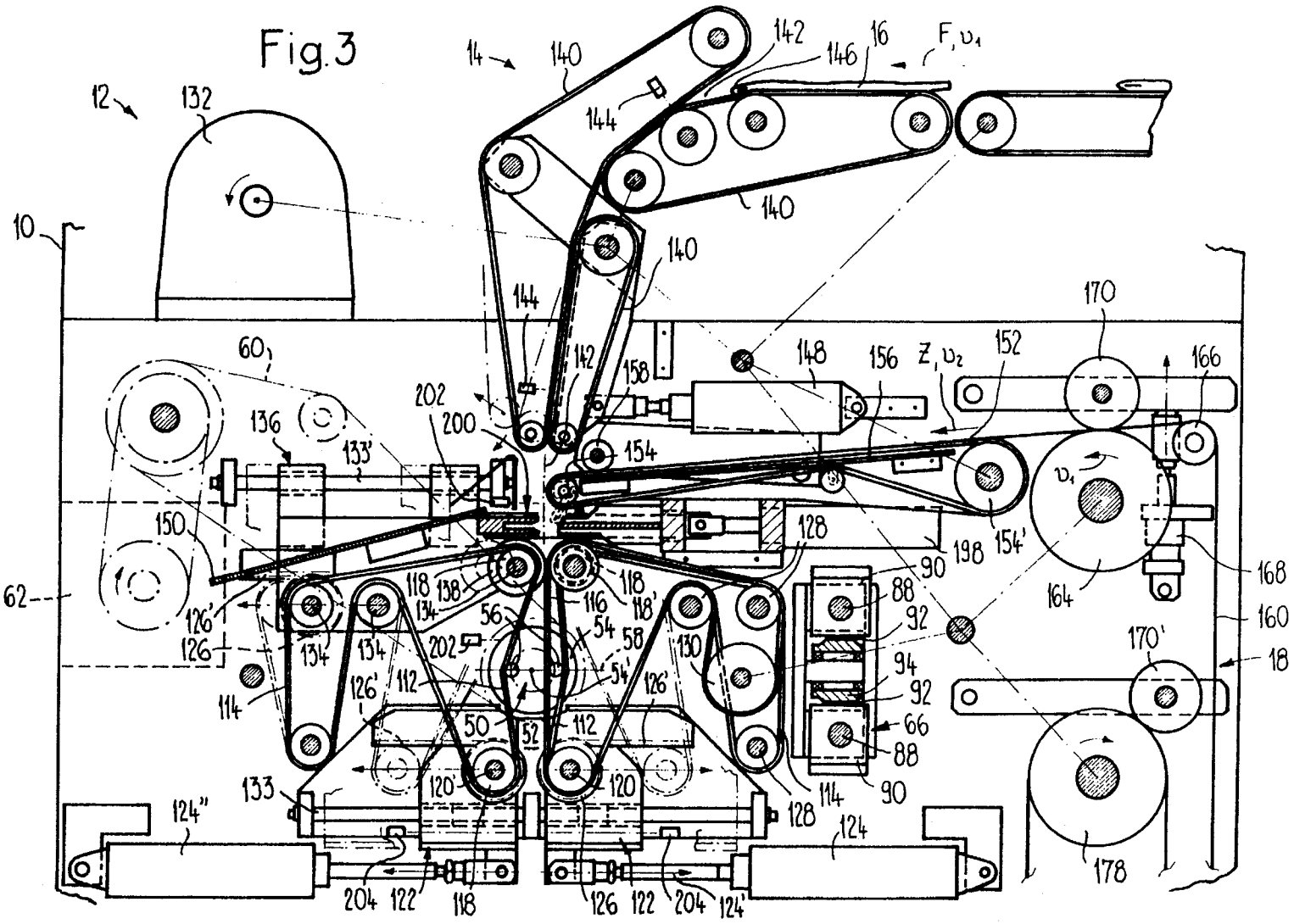
FIG. 3 shows enlarged with respect to FIG. 1 and partially in section the apparatus for producing the portable, tube-like packs.

Also fastened on the driving part 64 is a signalling member 84, for example a magnet or a wedge projecting in the radial direction, which interacts with a sensor 86 arranged on the machine frame 10 in order to emit a signal to a control unit (not shown) when the axial plane 58 is running in the horizontal direction (compare FIG. 3).

Figure 4:
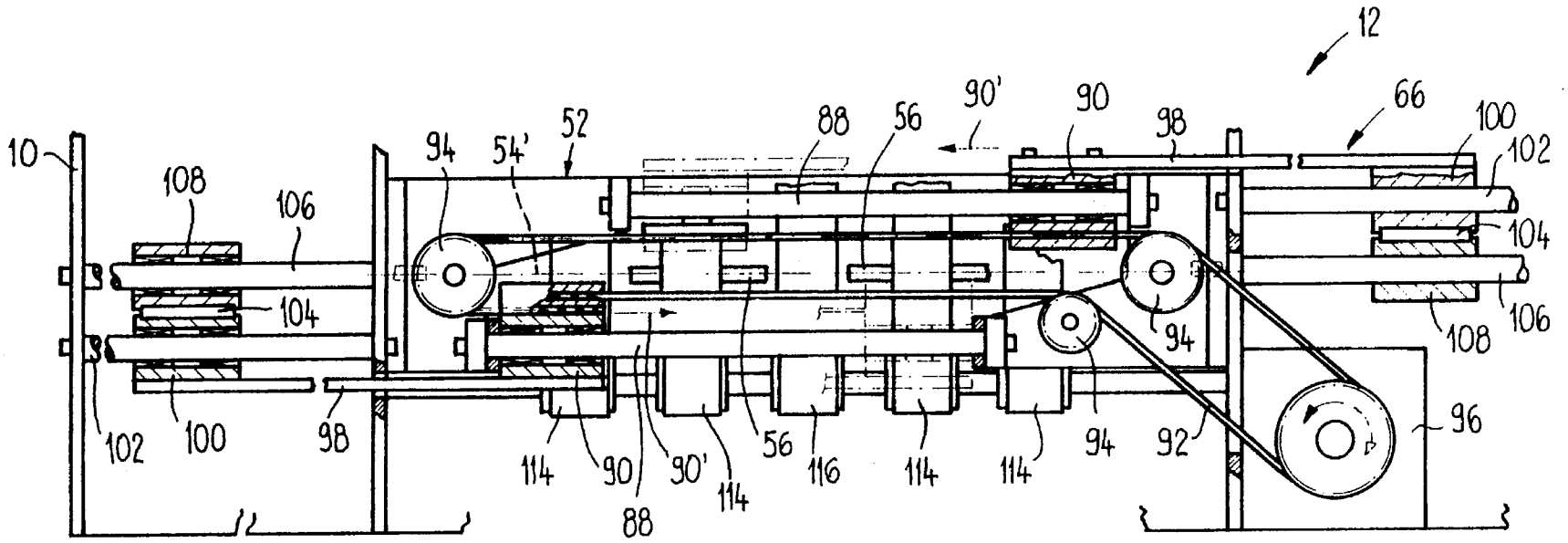
FIG. 4 shows in side elevation and partially in section the drive device for displacing the fingers in the axial direction.
Figure 5:
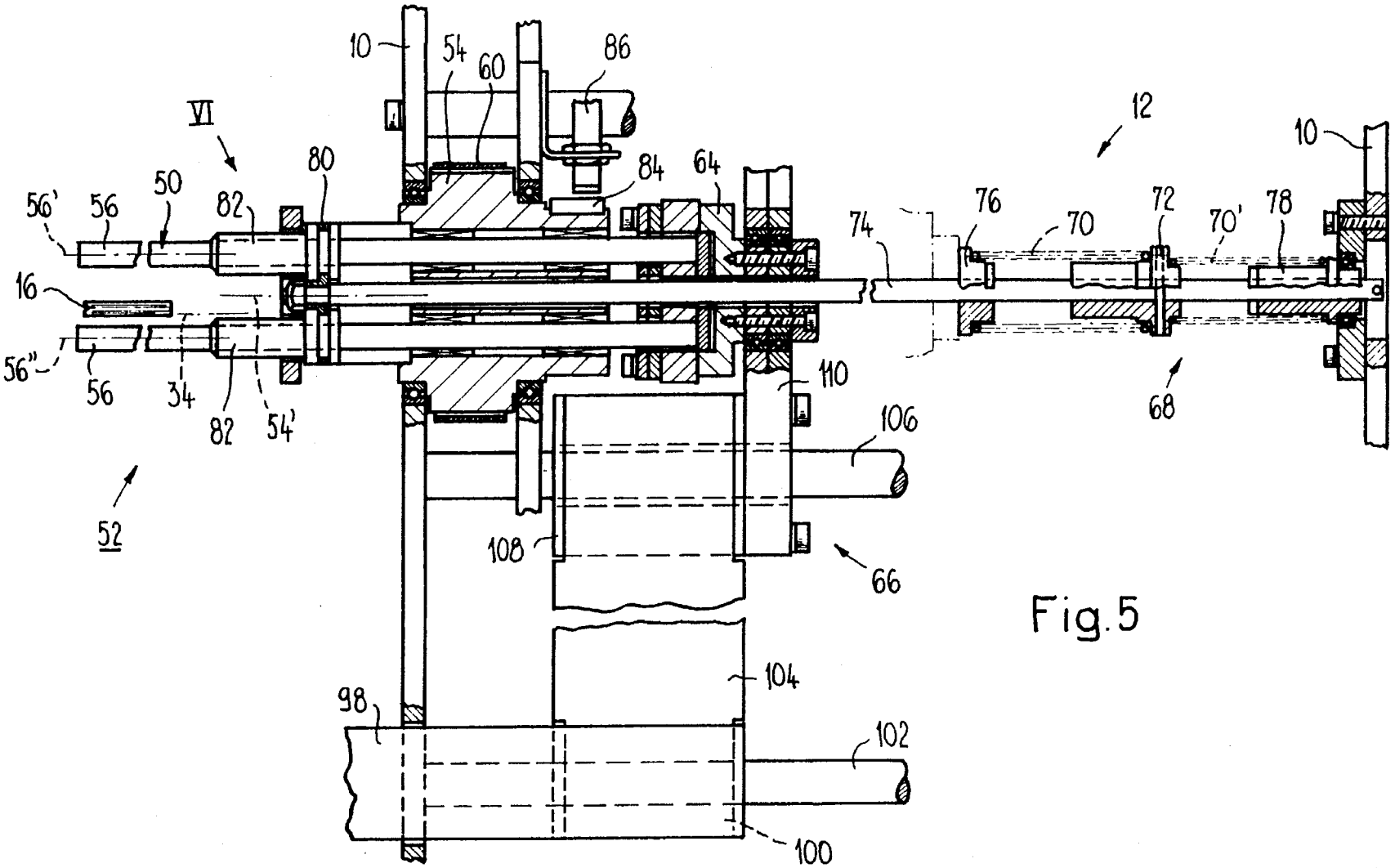
FIG. 5 shows in plan view and partially in section part of the device according to FIG. 4.
Figure 6:
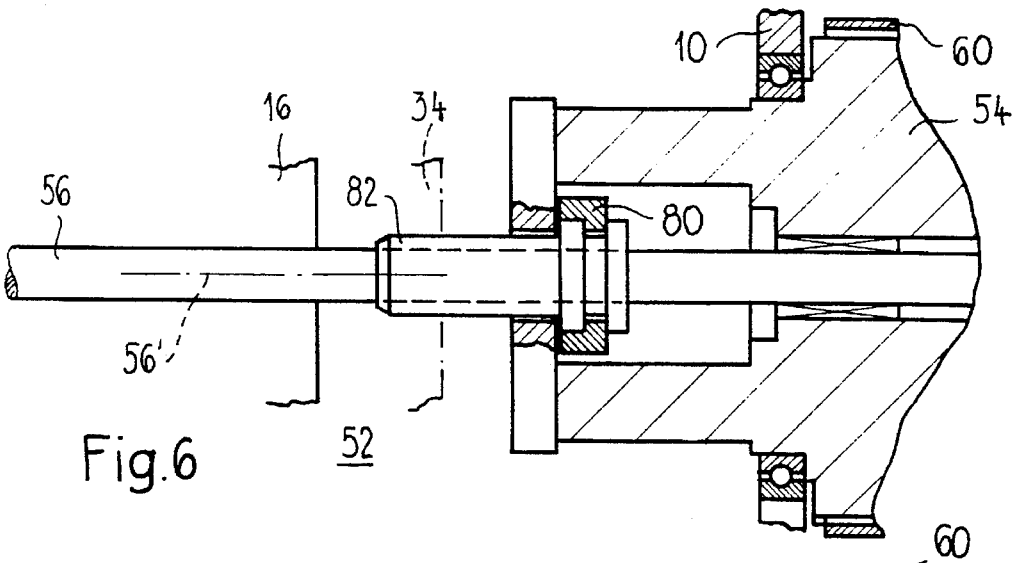
FIGS. 6 to 8 show the region, denoted in FIG. 5 by VI, enlarged, at various points in time of a working cycle.
Figure 7:
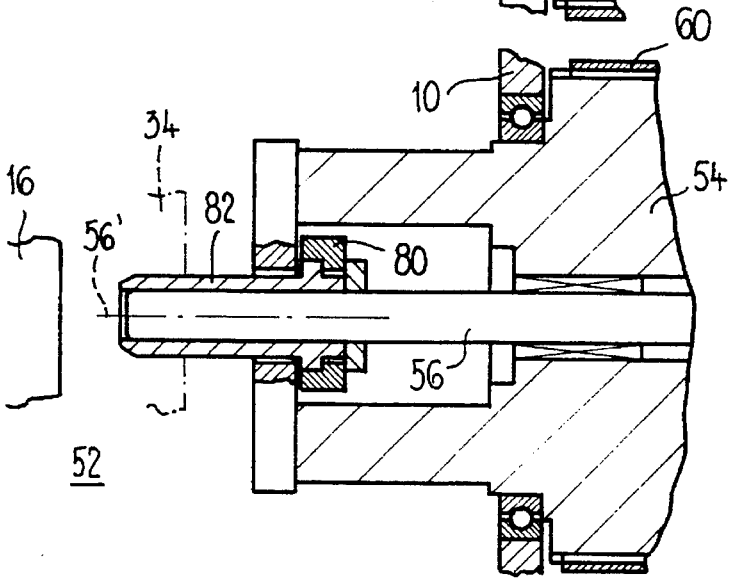

As can be seen in particular from FIGS. 3 and 4, the displacing device 66 has two carriages 90, which are each mounted on a guide shank 88 and of which one is fixedly connected to the upper strand and the other is fixedly connected to the lower strand of an endless drive belt 92. The drive belt, led around deflecting rollers 94, is connected to a reversible servo motor 96. The upper strand and lower strand run parallel to the guide shanks 88, arranged one above the other, and consequently drive the carriages 90 in opposite directions. The two carriages 90 are each connected by means of a driving rod 98 to an intermediate carriage 100, which is seated on a further guide shank 102, arranged coaxially with the relevant guide shank 88. Seen in the direction of the axis of rotation, said further guide shank is arranged outside the compartment 52. The intermediate carriages 100 are each connected by means of a connecting element 104, running at right angles with respect to the axis of rotation 54', to a guide carriage 108, which is mounted on a third guide shank 106 and from which for its part there protrudes a driving crosshead 110, to which the driving part 64 is connected.

Figure 8:
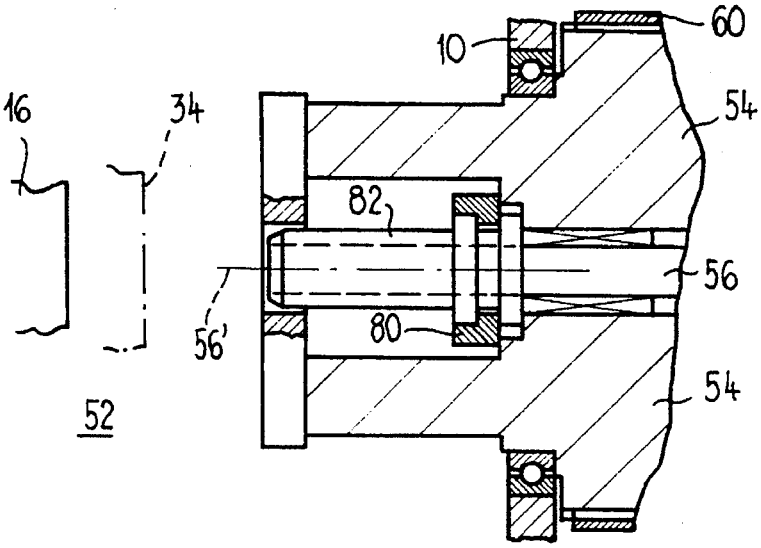

The rotary drive of the fingers 56 consequently takes place from the servo motor 62 via the toothed-belt drive 60 and the bearing part 54, which drives the fingers 56 along in a rotationally fixed manner. In order to move the fingers 56 into the compartment 54, the reversible servo motor 96 drives the drive belt 92 counterclockwise (FIG. 4). As a result, the carriages 90 are displaced out of their disconnected position, shown by solid lines, in the direction of the arrows 90' into the active position, indicated by dot-dashed lines. As a result, the fingers 56 are also brought out of their disconnected position, shown in FIG. 8, outside the compartment 52, into the active position, indicated in FIGS. 4 and 6, inside the compartment 52. For drawing the fingers 56 back into the disconnected position, the reversible servo motor 96 is driven clockwise. In this case, first of all only the fingers 56 are drawn back against the arrow direction 90', until they reach the position shown in FIG. 7. In this position, the driving part 64 also strikes against the stop member 76. Upon further moving, the springs 70, 70' are compressed, the springs 70' being compressed to a greater extent on account of the different spring constant. This has the consequence that the driving element 72 and the driving shank 74 are driven along. This in turn draws the plastic sleeves 82 back into the interior of the bearing part 54, as FIG. 8 shows. In the disconnected position, consequently neither the fingers 56 nor the plastic sleeves 82 project into the compartment 52. The braking device 68 consequently brakes the moved mass in the direction of the axis of rotation 54' and simultaneously controls the plastic sleeves 82. Upon displacing the fingers 56 back into the active position, the plastic sleeves 82 are also displaced in the direction toward the compartment 52 in a manner corresponding to the extension of the spring 70'.

The compartment 52 is bounded on both sides of the axis of rotation 54' by compartment walls 112. These are each formed by four endless belts 114 of flexible material, as FIG. 4 also reveals. On the side situated to the right of the axis of rotation 54' in FIG. 3, there is also provided a flexible conveyor belt 116, which is arranged in the axial direction between the two middle ones of the four belts 114. Once the fingers 56 are moved into their active position, into the compartment 52, they are spaced so far apart that they each project in the axial direction beyond the corresponding two belts 114, but end outside the region of the conveyor belt 116. At the upper end on the input side and at the lower end on the output side of the compartment 52, the belts assigned to the right-hand compartment wall 112 and the conveyor belt 116 are each deflected about coaxially mounted rollers 118, the roller 118', assigned to the conveyor belt 116 on the input side, being larger in diameter than the rollers 118, assigned to the belts 114. The shaft 120, bearing the output-side rollers 118, is mounted on a carriage part 122, which can be drawn back by means of a cylinder-piston unit 124 in the horizontal direction at right angles with respect to the axis of rotation 54' in the direction of the arrow 124' from the folding position, represented by solid lines, into the ejecting position, indicated by dot-dashed lines. In order to prevent tilting of the carriage part 122, on the shaft 120 there are seated on both sides in a rotationally fixed manner gear wheels 126, which mesh with toothed racks 126', fastened fixedly in place on the machine frame 10. On the side facing away from the compartment 52, the belts 114 are deflected in an S-shaped form, seen from the shaft 120, about corresponding rollers 128 and run from there back to the input-side rollers 118. The conveyor belt 116 is likewise deflected in an S-like manner, it engaging however, seen from the shaft 120, between the first and third rollers 128 around a drive roller 130. The latter is connected, as indicated by dot-dashed lines, to a drive motor 132 and is driven counterclockwise by means of a freewheel.

In a similar manner, the belts 114 forming the left-hand compartment wall 112 are deflected on the input side and output side of the compartment 52 about rollers 118. The shaft 120', bearing the output-side rollers 118, is mounted in the same manner as the shaft 120 on a second carriage part 122. The latter is mounted on the same guide rails 133, running on both sides and outside the compartment 52, as the other carriage part 122, arranged to the right of the axis of rotation 54'. Also seated on the shaft 120' at both ends are gear wheels 126, which mesh with corresponding toothed racks 126', in order to prevent tilting of the carriage part 122 when the latter is displaced by means of the piston-cylinder unit 124" out of the folding position, represented by solid lines, into the ejecting position, indicated by dot-dashed lines, and back again. Seen from the shaft 120', the belts 114 are in turn led in an S-shaped form around rollers 128, the first and third rollers 128, and also the input-side rollers 118 being mounted on shafts 134, which are supported on a carriage element 136. The latter is displaceable along lateral guide rails 133' in the horizontal direction at right angles with respect to the axis of rotation 54' by means of a cylinder-piston unit (not shown). The carriage element 136 is shown by solid lines in the pressing position, in which a freely rotatably mounted pressing roller 138, seated on the input-side shaft 134, bears against the conveyor belt 116 or against a printing product. The diameter of the pressing roller 138 is in this case larger than the diameter of the rollers 118. The carriage element 136 is shown by dot-dashed lines in the drawn-back insertion position, in which the pressing roller 138 is at a distance from the conveyor belt 116. Tilting of the carriage element 136 is also prevented here in that on one of the shafts 134 there are seated at both ends gearwheels 126, which in turn mesh with toothed racks 126'. For the sake of completeness, it should be mentioned that the belts 114 and the pressing roller 138 are mounted freely rotatably.

The conveying device 14 is designed as a belt conveyor, mutually interacting conveyor belts 140 bounding a conveying nip 142, into which the printing products 16, fed in the horizontal direction and conveying direction F, run and are deflected into an insertion plane 142, aligned with the compartment 52 and running substantially in the vertical direction. If, by means of sensor elements 144 arranged in the region of the conveying device 14, there is detected a printing product 16 of which the leading edge 146 is not running at right angles with respect to the conveying direction F, the delivery-side conveyor belts 140 of the conveying device 14 are swivelled out of the operating position, shown by solid lines, by means of the cylinder-piston unit 148 into a redirecting position, indicated by dot-dashed lines, in which the relevant printing product 16 is ejected onto a diverting plate 150, in order to be discharged in this way. The printing products 16 of which the leading edges 146 are running at right angles with respect to the conveying direction F are inserted by means of the conveying device 14 from above into the compartment 52.

For the sake of completeness, it should be mentioned that, as indicated by dot-dashed lines, the conveying device 14 is likewise driven by the drive motor 132.

Between the output-side end of the conveying device 14 and the upper input-side end of the compartment 52, the supply device 18 opens out into the path of movement of the printing products 16. Said device has a feed belt 152, which is driven in a circulating manner in feed direction Z and at a speed v2 which is greater than the conveying speed v1 of the conveying device 14. This feed belt is led on the output side around a deflecting roller 154, so that the feed belt 152 forms a tangent to the path of movement of the printing products 16. The deflecting roller 154' on the starting side is likewise connected to the drive motor 132. The upper strand of the feed belt 152 slides over a supporting plate 156 and mounted above the feed belt 152 there is a pressing roller 158, in order to press the film web 160, bearing against the upper strand of the feed belt 152, against the feed belt 152.

Figure 19:
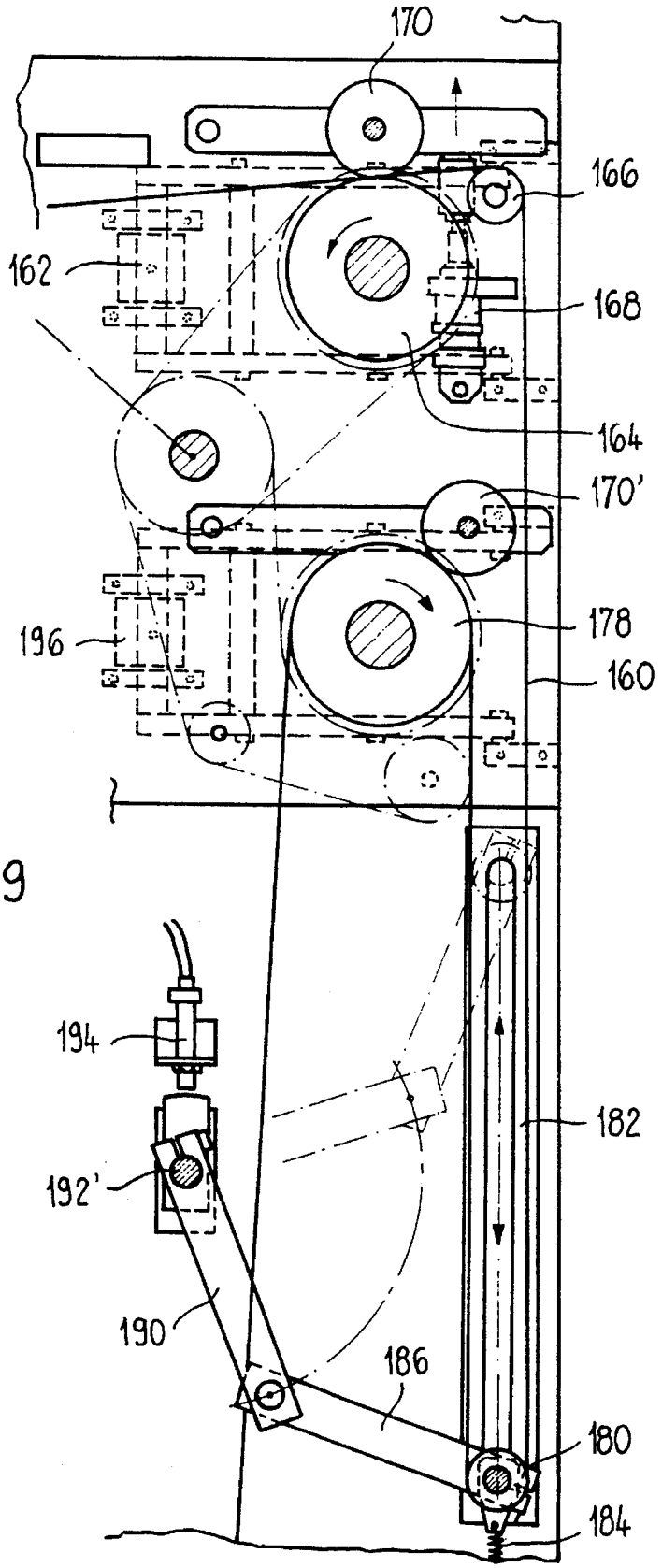
FIGS. 19 and 20 show in elevation, partially in section and enlarged with respect to FIG. 1, the supply device for the film-like retaining element, FIG. 19 showing the upper part and FIG. 20 showing the lower part.

Arranged upstream of the feed belt 152 is a first conveying roller 164, which is connected by means of a clutch/brake unit (not visible) to the drive motor 132, see also FIG. 19. This clutch/brake unit is actuated by a pneumatic cylinder-piston unit 162 via a linkage, represented by dashed lines in FIG. 19. The film web 160 runs from a deflecting roller 166 approximately tangentially over the first conveying roller 164 to the feed belt 152. With the first conveying roller 164 there interacts a pressing roller 170, which can be lifted by means of a control element 168, in order to press the film web 160 in a controlled manner against the first conveying roller 164.

Figure 20:
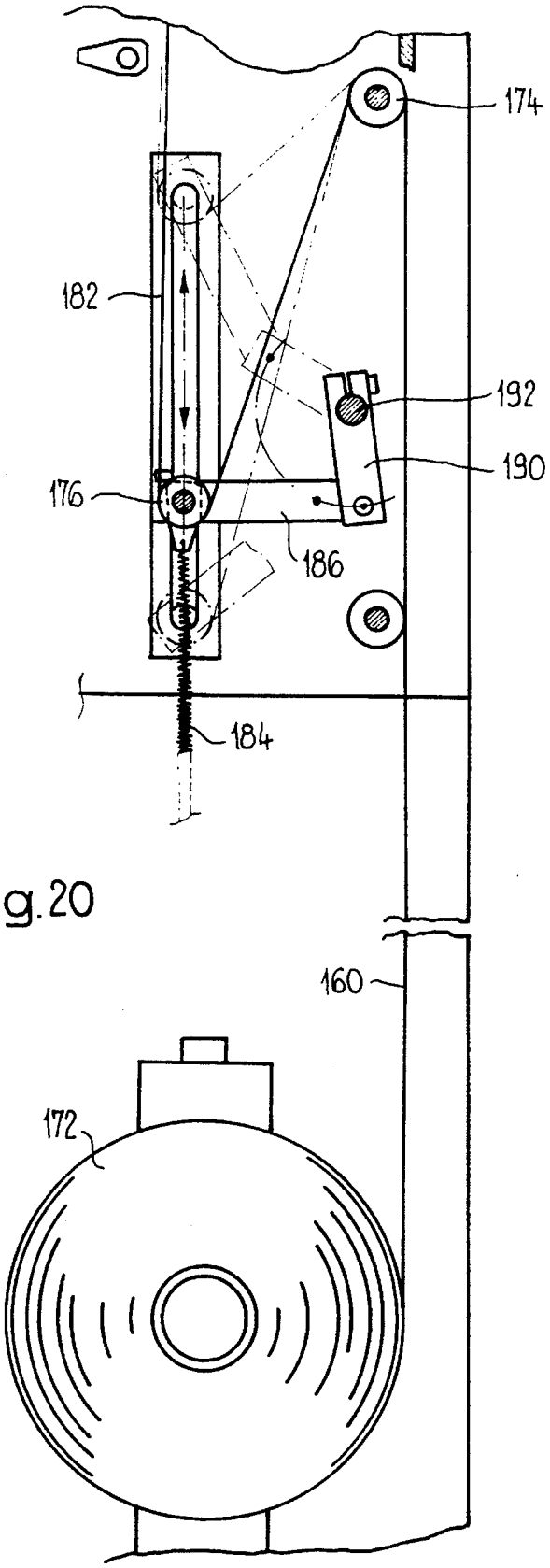

As FIG. 20 shows, the film web 160 is unwound from a rotatably mounted supply roller 172. From the latter, the film web 160 runs approximately in the vertical direction upward to a deflecting roller 174, from where it runs in a loop-like manner in the direction obliquely downward to a first idling roller 176. From there, the film web 160 is led to a second conveying roller 178, which it wraps around by about 180°. Between this second conveying roller 178 and the deflecting roller 166, the film web 160 wraps in a loop-like manner around a second idling roller 180. The two idling rollers 176, 180 are mounted freely displaceably in vertical guide members 182 and are each connected to springs 184, which have a flat spring characteristic in order to tension the film web 160 with an approximately constant force. Furthermore, the idling rollers 176, 180 are articulated at both ends on butt straps 186, which are connected at the other end to the free end of a lever 190, the levers 190 for their part being seated in a rotationally fixed manner on corresponding shafts 192, 192'. As a result, tilting of the idling rollers 176, 180 is prevented. Interacting with the shaft 192' is a position sensor 194, which emits a signal to the control unit when the second idling roller 180 is in the lower end region of the relevant guide member 182. The control unit provides the connection of the second conveying roller 178 via a clutch/brake unit to the drive motor 132 if the position sensor 194 does not emit a signal. The clutch/brake unit is actuated by a pneumatic cylinder-piston unit 196 via a linkage represented by dashed lines in FIG. 19. As a result, it is ensured that the supply loop of the film web 160 assigned to the second idling roller 180 is always automatically replenished. The film web 160 is permanently pressed against the second conveying roller 178 by means of a further pressing roller 170'. For the sake of completeness, it should be mentioned that the rollers interacting with the film web 160 have a surface which prevents adhering of the self-adhesive film web 160 to the rollers.

Arranged between the opening-out of the supply device 18 into the path of movement of the printing products 16 and the compartment 52 is a cutting device 200, which can be operated by means of a cylinder-piston unit 198 in order to detach the section of the film web 160 respectively forming a retaining element 34 from said web. The cross-sectionally U-shaped counterknife of the cutting device 200 (FIG. 3) is displaceable with the carriage element 136.

Finally, sensor members are denoted by 202, in order to detect the position of the leading edge 146 upon insertion of the printing product 16 to be processed into the compartment 52. Underneath the compartment 52 there are also further sensor members 204, which emit a signal to the control unit if the longitudinal extent of the pack 20 is no longer running in the approximately horizontal direction upon falling out of the compartment 52.

Figure 9:
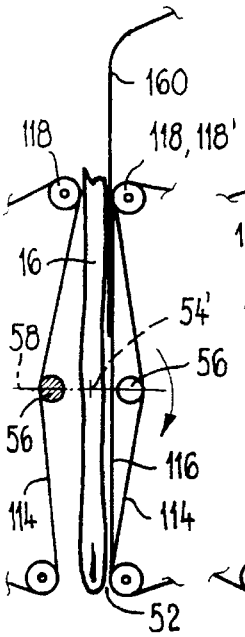
FIGS. 9 to 16 show greatly simplified the apparatus according to FIG. 3 at eight different points in time of a working cycle.

FIGS. 9 to 16 show the region of the compartment 52 of the pack-producing apparatus 12 greatly simplified. The same reference numerals as in the other figures are used. For inserting a printing product 16 into the compartment 52, the carriage element 136 is drawn back into the insertion position, indicated by dot-dashed lines in FIG. 3. The sensor member 202 arranged at the opening-out of the supply device 18 generates a signal upon passing by of the leading edge 146, after which, following a short delay time, the carriage element 136 is displaced into the pressing position. As a result, the pressing roller 138 presses the printing product 16 against the conveyor belt 116, likewise driven at the conveying speed v1. The printing product 16 is consequently always held, even when it has left the conveying device 14. The carriage parts 122 are in the folding position, the distance between the rollers 118 at the lower end of the compartment 52 being greater than the thickness of the printing product 16 to be processed, so that the latter can move freely through the relevant gap. The printing product runs in between the stationary fingers 56, the axial plane 58 running at right angles with respect to the approximately vertical insertion plane 142. The sensor member 202, arranged at the compartment 52 likewise emits a signal to the control unit, in order to keep a check on the position of the printing product 16 during insertion. Since the control unit knows the conveying speed v1, the dimension of the printing product 16 and the time at which the leading edge 146 runs through at the sensor members 202, it switches on the servo motor 62 for turning the fingers 56 about the axis of rotation 54' as soon as the printing product 16 has reached a position approximately symmetrical with respect to the axis of rotation 54' (FIG. 9). In this position, the axial plane consequently runs centrally through the printing product 16. For the sake of completeness, it should be mentioned that, upon insertion of a printing product 16, the pairs of fingers 50 are in the active position, so that the belts 114 bear against the fingers 56 on the outer side thereof with respect to the axis of rotation 54'. The conveyor belt 116 does not bear against the fingers 56.

As soon as about two thirds of the printing product 16 have run past the opening-out of the supply device 18, the first conveying roller 164 is connected via the clutch/brake unit to the drive motor 132, whereby the region of the film web 160 between its free end at the cutting device 200 and the second idling roller 180 is then accelerated extremely quickly to the conveying speed v1 and thus the printing product 16 is provided with the leading end region. Once the free end of the film web 160 has run into the compartment 52, the pressing roller 170 is raised, so that, during folding of the printing product 16 and winding up around the folded printing product 16, the film web 160 can be drawn further at higher speed, uninfluenced by the first conveying roller 164.

Figure 10:
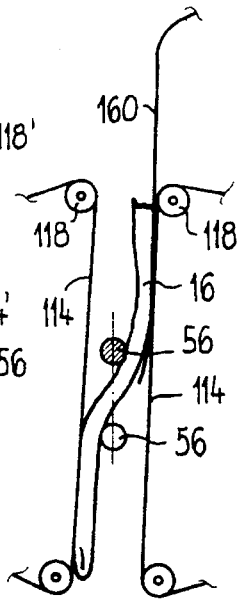
Figure 11:
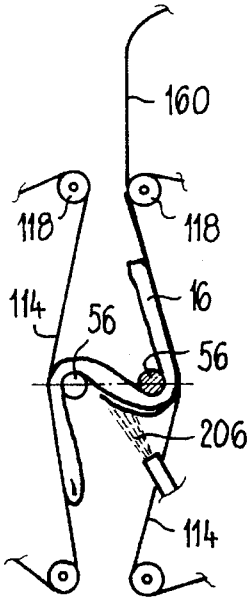

FIGS. 10 to 16 show the position of the fingers 56, after in each case a clockwise turn through 90° about the axis of rotation 54', starting from FIG. 9. As FIGS. 10 and 11 show, the part of the printing product 16 arranged above the axis of rotation 54' in FIG. 9 then extends through the gap which is bounded by the fingers 56, then above or to the right of the axis of rotation 54', hatched for better identification, and the conveyor belt 116 and the belt 114 to the right of the axis of rotation 54', whereby this product part is bent around the relevant finger 56 by the action of the said flexible belts 114, 116. In the same manner, the other product part extends through the gap between the other finger, drawn non-hatched in FIGS. 9 to 16, and the belt 114 to the left of the axis of rotation 54'. This product part is bent in the same manner around the relevant finger 56. An air jet 206 ensures that the free end of the film web 160 remains adhering to the outer-lying side of the printing product 16 during bending of the printing product around the finger 56 shown hatched. Approximately at the same time as the beginning of turning of the fingers 56, the carriage element 136 is drawn back into the insertion position, since the belts 114, 116 arranged to the right and left of the compartment 52 circulate counterclockwise during folding of the printing product 16. The free mounting of the belts 114 and the drive of the conveyor belt 116 by means of a freewheel then ensure that these belts 114, 116 can move at the same speed as the part of the printing product 16 bearing against them. Furthermore, it should be noted that the film web 160 does not come into contact with either of the fingers 56.

Figure 12:
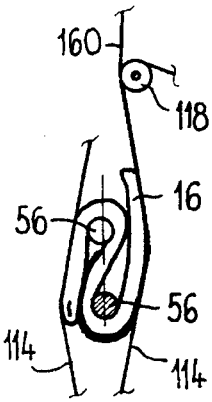

As FIG. 12 shows, after an about three-quarters revolution of the fingers 56, the printing product 16 is already folded in an S-shaped form and has been brought into the tube-like form. A further turning of the fingers 56 is necessary, however, in order to wind up the section of the film web 160 onto the folded printing product 16 to such an extent that the latter is sheathed completely.

Figure 13:
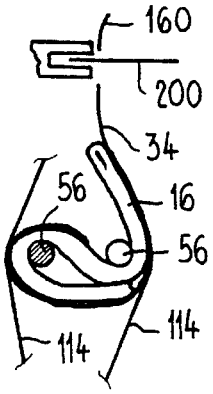
Figure 14:
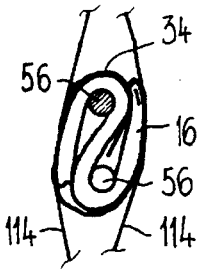
Figure 15:
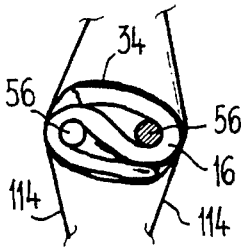
Figure 16:
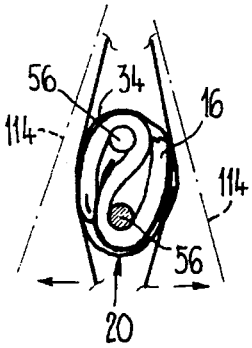

As FIG. 13 shows, the cutting device 200 detaches the section forming the retaining element 34 from the film web 160 as soon as the latter has been drawn further by a corresponding length. In the present case, after about one turn of the fingers 56 through about 360°. Upon further turning of the fingers 56, the remaining part of the retaining element 34 is then also wound around the printing product 16 and pressed against the latter by means of the belts 114 and the conveyor belt 116 (compare FIGS. 14 and 15).

As soon as the retaining element 34 sheathes the printing product 16 completely, after about one and three-quarter revolutions of the fingers 56, the piston-cylinder units 124, 124" are activated, in order to draw the carriage parts 122 back into the ejecting position. The path followed by the conveyor belt 116 and the belt 114 is indicated by dot-dashed lines in FIG. 16; these belts then no longer bear against the pack 20 formed. For separating the fingers 56 from the pack 20, the reversible servo motor 96 is driven clockwise (FIG. 4), in order to draw back the fingers 56 at high speed in the direction of the axis of rotation 54' out of the region of the compartment 52 into the disconnected position (FIG. 8). The pack 20 then falls into the first stack compartment 22. The servo motor 96 is immediately reversed again, in order to bring the fingers 56 back into their active position. Furthermore, the servo motor 62 was switched off immediately as soon as the retaining element 34 was wound up completely and the axial plane 58 is running in the horizontal direction. As soon as the fingers have reached the active position, the piston-cylinder units 124, 124" displace the carriage parts 122 back into the folding position. The next printing product 16 can then be inserted into the compartment 52. The sequences successively described above may entirely or partially overlap in time.

Figure 18:
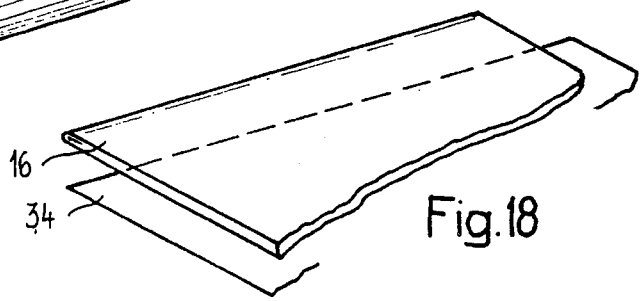
FIG. 18 shows in perspective representation part of a printing product and of the retaining element which projects laterally beyond the printing product.

FIG. 17 shows a pack 20 with the printing product 16 folded in an S-shaped form and with the film-like retaining element 34. Seen in the longitudinal extent of the tube-like pack 20, the retaining element 34 has the same dimension as the printing product 16. However, in order to be able to protect the latter better, it is also possible to use for forming the retaining element 34 a film web 160 which is wider than the corresponding dimension of the printing product 16, as is indicated in FIG. 18. The film web 160 in this case projects on both sides beyond the printing product 16. Since the film web 160 is kept under tensile stress, the part projecting laterally beyond the printing product 16 then has the tendency during and after winding up to bend inwardly in the radial direction. In this case, the plastic sleeves 82 prevent the retaining element 34 from being able to touch the fingers 56 and adhere to them.

When advancing the film web 160 at great speed, first of all, by raising the second idling roller 180, the relevant supply loop is shortened, indicated by dot-dashed lines in FIG. 19. As soon as the position sensor 194 then detects this, the second conveying roller 178 is driven in order to increase the said supply loop again. As a result, the first idling roller 176 is raised (indicated by dot-dashed lines in FIG. 20). The relevant spring 184 ensures, however, that film is drawn further and unwound from the supply roller 172. On the one hand, the springs 184 ensure that the film web 160 is always tensioned and, on the other hand, they prevent overstressing during the fast accelerating and conveying of the film web 160.

In the example shown, the fingers 56 are spaced so far apart that the printing product 16 is folded substantially only in an S-shaped form. In the case of longer printing products 16, seen in the conveying direction, or in the case of fingers 56 arranged closer together, it is also possible for the parts of the printing products still remaining outside the S-shaped folding to be wound up. Since, however, the printing product 16 was positioned approximately symmetrically with respect to the axis of rotation 54', a minimal number of revolutions of the fingers 56 is always required for bringing the printing products 16 into the tube-like form.

It is also conceivable to bring only one of the two carriage parts 122 into the ejecting position in each case. As a result, a uniform filling of the first stack compartment 22 can be achieved.

A further point which should be mentioned is that, due to the symmetrical, S-shaped folding of the printing product 16, the distortion of the printing product 16 caused by its thickness is reduced and is even compensated for completely. This also means that, in the case of printing products 16 of which the leading edge 146 is formed by a fold edge, in the falling described no mutual displacement of the sheets of the product occurs on the open side edge (margin) opposite the fold edge.

The folded, bound or bonded finished printing products are advantageously inserted into the compartment 51 with the fold or the bonded edge ahead.

In the drawings and specification, there has been set forth a preferred embodiment of the invention, and although specific terms are employed, they are used in a generic and descriptive sense only and not for purposes of limitation.

That which is claimed is:

1. An apparatus for producing portable, tube-like packs (20) from printing products (16) and comprising a machine frame (10), a bearing part (54) rotatably mounted to said frame for rotation about a horizontal axis of rotation (54'), at least one pair of fingers (56) mounted to said bearing part (54) so that said fingers are disposed along parallel axes which are parallel to and on opposite sides of said axis of rotation, a pair of upright counter-elements (112) mounted to said frame in generally opposing relationship and on respective opposite sides of said axis of rotation and outside of said one pair of fingers, drive means for selectively rotating said bearing part and thus said one pair of fingers about said axis of rotation and such that said one pair of fingers may be rotated to a horizontally spaced apart initial position which defines a horizontal plane (58), and printing product conveying means (14) for serially delivering printing products vertically between said one pair of fingers when said fingers are in said initial position and to an operative position wherein the printing product is positioned substantially symmetrically with respect to the axis of rotation, whereby upon delivery of a printing product to said operative position, the bearing part may be rotated about said axis of rotation and so that one of said fingers presses one portion of the printing product into contact with one of said counter-elements and the other of said fingers presses another portion of the printing product into contact with the other of said counter-elements, thereby causing the printing product to be bent about the fingers and formed into a wound pack (20), said counter-elements (112) forming opposing walls of a compartment (52) into which the printing products are delivered by said conveying means, with said walls extending in a direction parallel to said axis of rotation, and wherein each of said counter-elements comprises at least one endless belt (114), with each of said endless belts being mounted so as to be entrained about respective ones of an upper pair of deflecting rollers (118) and a lower pair of deflecting rollers (118), with both of said pairs being mounted to said frame for rotation about axes which are parallel to said axis of rotation, means mounting said one pair of fingers for selective movement in an axial direction so as to permit a wound package (20) to be released after being formed, and means mounting said lower pair of deflecting rollers to said frame so as to permit them to be laterally separated and a wound pack (20) to freely drop therebetween.

2. The apparatus as defined in claim 1 further comprising means for feeding and applying a retaining element (34) to the wound pack and so as to maintain the wound pack in its wound form.

3. The apparatus as defined in claim 2 wherein said retaining element (34) comprises a film web (160), and wherein said feeding and applying means includes means for feeding the film web from a supply package thereof into the conveying path of the printing products and so that at least about the trailing half of each printing product is covered with an overlying piece of the film web when the printing product is in said operative position.

4. The apparatus as defined in claim 1 wherein said apparatus comprises two of said pairs of fingers, with each pair being mounted to respective bearing parts (54) and so as to have coaxial axes of rotation and be disposed in an opposing axially spaced apart relationship.

5. The apparatus as defined in claim 4 further comprising means mounting each of said two pairs of fingers for selective movement in an axial direction toward and away from each other and so as to permit a wound pack (20) to be released after being formed.

6. The apparatus as defined in claim 1 wherein said deflecting rollers of said upper pair are horizontally spaced apart so as to permit the printing products to be delivered therebetween by said conveying means.

7. The apparatus as defined in claim 6 wherein said conveying means (14) includes a conveyor belt (116) entrained about the upper and lower deflecting rollers (118', 118) on one side of said axis of rotation, drive means for circulating the conveyor belt in a conveying direction (F), and a pressing element (138) mounted to cooperate with said conveyor belt to form a conveying nip for each printing product as it is delivered to said operative position by said conveying means.

8. The apparatus as defined in claim 7 further comprising means mounting at least one of said conveyor belt and said pressing element for selective lateral movement so as to facilitate the insertion of the leading edge of a printing product therebetween.

9. The apparatus as defined in claim 1 wherein said conveying means (14) includes a conveyor belt (116) entrained about the upper and lower deflecting rollers (118', 118) on one side of said axis of rotation, drive means for circulating the conveyor belt in a conveying direction (F), and a pressing element (138) mounted to cooperate with said conveyor belt to form a conveying nip for each printing product as it is delivered to said operative position by said conveying means.

10. An apparatus for producing portable, tube-like packs (20) from printing products (16) and comprising a machine frame (10), a bearing part (54) rotatably mounted to said frame for rotation about a horizontal axis of rotation (54'), at least one pair of fingers (56) mounted to said bearing part (54) so that said fingers are disposed along parallel axes which are parallel to and on opposite sides of said axis of rotation, a pair of upright counter-elements (112) mounted to said frame in generally opposing relationship and on respective opposite sides of said axis of rotation and outside of said one pair of fingers, drive means for selectively rotating said bearing part and thus said one pair of fingers about said axis of rotation and such that said one pair of fingers may be rotated to a horizontally spaced apart initial position which defines a horizontal plane (58), and printing product conveying means (14) for serially delivering printing products vertically between said one pair of fingers when said fingers are in said initial position and to an operative position wherein the printing product is positioned substantially symmetrically with respect to the axis of rotation, whereby upon delivery of a printing product to said operative position, the bearing part may be rotated about said axis of rotation and so that one of said fingers presses one portion of the printing product into contact with one of said counter-elements and the other of said fingers presses another portion of the printing product into contact with the other of said counter-elements, thereby causing the printing product to be bent about the fingers and formed into a wound pack (20), said counter-elements (112) forming opposing walls of a compartment (52) into which the printing products are delivered by said conveying means, with said walls extending in a direction parallel to said axis of rotation, and wherein each of said counter-elements comprises at least one endless belt (114), with each of said endless belts being mounted so as to be entrained about respective ones of an upper pair of deflecting rollers (118) and a lower pair of deflecting rollers (118), with both of said pairs being mounted to said frame for rotation about axes which are parallel to said axis of rotation, said deflecting rollers of said upper pair being horizontally spaced apart so as to permit the printing products to be delivered therebetween by said conveying means, means mounting said lower pair of deflecting rollers to said frame so as to permit them to be laterally separated and a wound pack (20) to freely drop therebetween, and said conveying means (14) including a conveyor belt (116) entrained about the upper and lower deflecting rollers (118', 118) on one side of said axis of rotation, drive means for circulating the conveyor belt in a conveying direction (F), and a pressing element (138) mounted to cooperate with said conveyor belt to form a conveying nip for each printing product as it is delivered to said operative position by said conveying means.

11. The apparatus as defined in claim 10 further comprising means mounting at least one of said conveyor belt and said pressing element for selective lateral movement so as to facilitate the insertion of the leading edge of a printing product therebetween.

12. An apparatus for producing portable, tube-like packs (20) from printing products (16) and comprising a machine frame (10), a bearing part (54) rotatably mounted to said frame for rotation about a horizontal axis of rotation (54'), at least one pair of fingers (56) mounted to said bearing part (54) so that said fingers are disposed along parallel axes which are parallel to and on opposite sides of said axis of rotation, a pair of upright counter-elements (112) mounted to said frame in generally opposing relationship and on respective opposite sides of said axis of rotation and outside of said one pair of fingers, drive means for selectively rotating said bearing part and thus said one pair of fingers about said axis of rotation and such that said one pair of fingers may be rotated to a horizontally spaced apart initial position which defines a horizontal plane (58), printing product conveying means (14) for serially delivering printing products vertically between said one pair of fingers when said fingers are in said initial position and to an operative position wherein the printing product is positioned substantially symmetrically with respect to the axis of rotation, whereby upon delivery of a printing product to said operative position, the bearing part may be rotated about said axis of rotation and so that one of said fingers presses one portion of the printing product into contact with one of said counter-elements and the other of said fingers presses another portion of the printing product into contact with the other of said counter-elements, thereby causing the printing product to be bent about the fingers and formed into a wound pack (20), said counter-elements (112) forming opposing walls of a compartment (52) into which the printing products are delivered by said conveying means, with said walls extending in a direction parallel to said axis of rotation, and wherein each of said counter-elements comprises at least one endless belt (114), with each of said endless belts being mounted so as to be entrained about respective ones of an upper pair of deflecting rollers (118) and a lower pair of deflecting rollers (118), with both of said pairs being mounted to said frame for rotation about axes which are parallel to said axis of rotation, said conveying means (14) including a conveyor belt (116) entrained about the upper and lower deflecting rollers (118',118) on one side of said axis of rotation, drive means for circulating the conveyor belt in a conveying direction (F), and a pressing element (138) mounted to cooperate with said conveyor belt to form a conveying nip for each printing product as it is delivered to said operative position by said conveying means.

13. An apparatus for producing portable, tube-like packs (20) from printing products (16) and comprising a machine frame (10), printing product conveying means (14) mounted to said frame for serially delivering printing products along a first path of travel and to an operative position, means mounting a supply package (172) of a film web to said frame, means (18) for withdrawing the film web from the supply package and feeding the same along a second path of travel which intersects the first path of travel immediately upstream of the operative position, and including (a) a first conveying roller (164), (b) a second conveying roller (178) disposed between said supply package and said first conveying roller, (c) a first prestressed idler roller (176) mounted between said supply package and said second conveying roller and so as to form a first supply loop in the second path of travel, (d) a second prestressed idler roller (180) mounted between said second conveying roller and said first conveying roller and so as to form a second supply loop in the second path of travel, said second prestressed idler roller (180) being mounted for movement so as to vary the size of the second supply loop, (e) a film web severing device (200) positioned adjacent the location at which the second path of travel intersects the first path of travel, (f) control means for cyclically rotating the first and second conveying rollers and cyclically actuating said film web severing device, and such that a segment of the film web advances with each printing product to its operative position and is severed from the remainder of the film web and so that the segment overlies at least a substantial portion of one side of the printing product in its operative position, and such that said control means acts to rotate said second conveying roller (178) in response to the position of said second prestressed idler roller (180) to maintain the second supply loop of predetermined size, and means (12) for winding each printing product which is located at said operative position into a tube-like form and while winding the overlying film web segment thereabout so as to maintain the wound configuration of the printing product and form a wound pack (20).

14. The apparatus as defined in claim 13 wherein said control means acts to rotate the first conveying roller (164) at a circumferential speed which approximately corresponds to the conveying speed (v1) of said printing product conveying means (14), and wherein said withdrawing means (18) further comprises a belt conveyor (152) positioned between the first conveying roller (164) and the first path of travel of the printing products, and means for driving the belt conveyor at a speed (v2) greater than the conveying speed (v1).

15. The apparatus as defined in claim 14 wherein said withdrawing means (18) further comprises a pressing roller (170) for pressing the film web against the first conveying roller (164).

16. The apparatus as defined in claim 12 wherein said winding means (12) comprises (a) a bearing part (54) rotatably mounted to said frame for rotation about a horizontal axis of rotation (54'), (b) at least one pair of fingers (56) mounted to said bearing part (54) so that said fingers are disposed along parallel axes which are parallel to and on opposite sides of said axis of rotation, (c) a pair of upright counter-elements (112) mounted to said frame in generally opposing relationship and on respective opposite sides of said axis of rotation and outside of said one pair of fingers, and (d) drive means for selectively rotating said bearing part and thus said one pair of fingers about said axis of rotation and such that said one pair of fingers may be rotated to a horizontally spaced apart initial position which defines a horizontal plane (58), said printing product conveying means (14) acting to serially deliver printing products vertically between said one pair of fingers when said fingers are in said initial position and to said operative position and such that each delivered printing product is positioned substantially symmetrically with respect to the axis of rotation, whereby upon delivery of a printing product to said operative position, the bearing part may be rotated about said axis of rotation and so that one of said fingers presses one portion of the printing product into contact with one of said counter-elements and the other of said fingers presses another portion of the printing product into contact with the other of said counter-elements, thereby causing the printing product to be bent about the fingers and formed into a wound pack (50).

* * * * *